United States Patent [19]

Amtsberg

[11] 3,945,442

[45] Mar. 23, 1976

[54] HYDRAULIC ROCK DRILL WITH STROKE RESPONSIVE ADVANCE

[75] Inventor: Lester A. Amtsberg, Utica, N.Y.

[73] Assignee: Chicago Pneumatic Tool Company, New York, N.Y.

[22] Filed: Oct. 7, 1974

[21] Appl. No.: 512,506

[52] U.S. Cl. ..... 173/10; 91/171

[51] Int. Cl.[2] ..... E21C 5/10

[58] Field of Search ..... 173/10, 105, 134, 139; 91/300, 318, 321, 171; 92/85

[56] References Cited

UNITED STATES PATENTS

| | | | |
|---|---|---|---|
| 689,516 | 12/1901 | Rattek | 173/10 |
| 2,228,338 | 1/1941 | Bennett | 91/321 X |
| 3,747,694 | 7/1973 | Kollandsrud | 173/105 X |
| 3,774,502 | 11/1973 | Arndt | 91/300 X |

FOREIGN PATENTS OR APPLICATIONS

| | | | |
|---|---|---|---|
| 299,538 | 1/1916 | Germany | 173/139 |

*Primary Examiner*—Ernest R. Purser
*Attorney, Agent, or Firm*—Stephen J. Rudy

[57] ABSTRACT

A rock drill having a control valve hydraulically operable to effect feed of oil from a bulk reservoir alternately to opposite ends of a power piston carrying a drill string to reciprocate the piston; having a motor for rotating the piston as the latter reciprocates; having a snubber for absorbing shocks in the event of piston override; and having carriage means automatically and hydraulically operable during reciprocation of the piston to feed the tool along a guide channel relative to the work.

3 Claims, 8 Drawing Figures

CYLINDER
2
3
5
1B
10
11
12
13
14
18
19
21
22
23
24
25
26
27
28
29
30
33
34
45
52
53
55
57
59
61
62
63
65
76
78
79
80
81
82
83
84
85
86
87
88

HYDRAULIC ROCK DRILL WITH STROKE RESPONSIVE ADVANCE

BACKGROUND OF THE INVENTION

This invention relates to hydraulically operable rock drills of a type having a power piston adapted to carry a drill string.

A rock drill is disclosed in my co-pending companion applications—Ser. No. 468,899, filed May 10, 1974 for An Hydraulic Tool, and Ser. No. 479,208, filed June 14, 1974 for An Hydraulic Rock Drill Tool having Automatic Carriage Feed--wherein the housing of the tool defines a bulk oil accumulator about a power piston to provide a proximity source of pressurized oil to reciprocate the piston which is designed to carry a work implement, such as a drill string and attached rock bit; wherein a rotation motor operating independently of the piston functions to rotate the piston without interfering with the reciprocating action of the latter; wherein a valve controlling feed of pressurized oil from the accumulator to reciprocate the piston is powered by a motor operating continuously from oil also flowing to it from the accumulator; and wherein a carriage carrying the tool is hydraulically movable along a guide channel to feed the tool relative to the work concurrently with the reciprocating action of the piston.

The present invention represents a variation from the structure set forth in my aforementioned companion applications, particularly in that it eliminates the motor for effecting operation of the control valve, and provides other hydraulically operable means to this end; in that it provides a distinctly different mode of operation for effecting automatic hydraulic feed of the carriage mounted tool along the guide channel; and in that it includes snubber means for absorbing shocks in the event of an overriding action of the piston.

In accordance with the present invention, there is provided an hydraulic rock drill comprising a housing; a piston cylinder in the housing; a floating piston hydraulically reciprocable in the cylinder having a piston rod adapted externally of the housing for attachment of a drill string thereto; a bulk oil reservoir in the housing surrounding the cylinder providing a proximity source of constantly pressurized oil for reciprocating the piston; control valve means in the housing for causing effective application of pressurized oil from the reservoir alternately to opposite ends of the piston to reciprocate the latter; hydraulically operable plunger means for actuating the control valve means; means determining the operation of the plunger means as a consequence of reciprocating action of the piston; snubber means disposed in the cylinder in the forward path of the piston for damping overriding forward movement of the piston on a work stroke; a rotation motor mounted to the housing having a drive shaft in axial alignment with the piston; a slidable spline connection between the piston and the drive shaft allowing concurrently transmission of rotation of the drive shaft to the piston and axial movement of the piston relative to the drive shaft; carriage means mounting the housing for movement along a guide channel relative to a work objective; and hydraulically operable carriage feed means connected with the carriage effective following a predetermined extent of movement of the piston relative to the cylinder on a work stroke to move the carriage together with the housing forwardly along the guide channel.

DESCRIPTION OF PREFERRED EMBODIMENT

Figure 1:
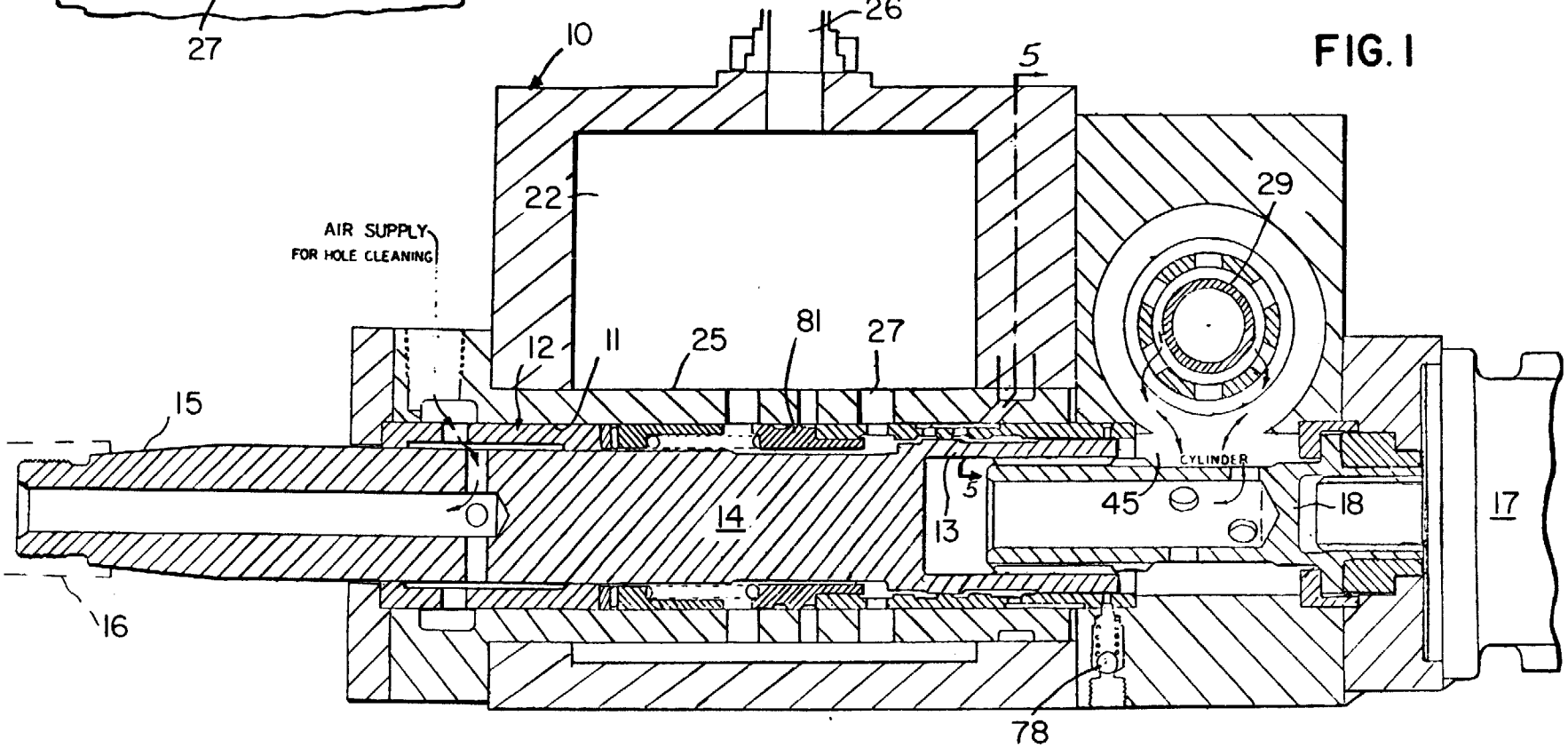
FIG. 1 is a longitudinal section of an hydraulic rock drill tool embodying the invention.

The rock drill presented in the drawing as illustrating a preferred embodiment of the invention includes a general housing 10 having a bore 11 in which a piston cylinder (generally indicated at 12) is fitted. A piston 13, formed at the rear of a piston rod 14, is hydraulically reciprocable in the cylinder. An externally projecting end 15 of the piston rod has removably attached thereto a conventional drill string 16 carrying a rock bit (not shown) at its bottom end.

A rotation motor 17, operable independently of the operation of the piston, is provided to transmit rotation through the piston and drill string to the rock bit during a drilling operation. The motor, which is mounted to the rear of the housing, has an extended drive shaft 18 having a splined driving connection 19 with the piston. The connection 19 is provided by internal splines formed in a recess of the piston slidably engaging complementary splines of the drive shaft. The connection allows rotation of the piston by the drive shaft, as well as axial reciprocation of the piston relative to the drive shaft.

The piston has an annular front area defined by a shoulder 21 which is subject to pressure of hydraulic fluid from a bulk oil accumulator or reservoir 22 to move the piston in a rearward or return stroke direction; and the piston has a relatively greater rear area, defined by the combined areas of an annular rear end wall 23 and a recessed back 24, which combined rear area is subject to fluid pressure from the reservoir to drive the piston in a forward or work stroke direction.

The reservoir 22 is in the form of an annular chamber extending about a core portion 25 of the housing. The core is located in the lower half of the housing in eccentric relation to the reservoir. A conventional pumping system to an inlet 26 maintains the reservoir constantly pressurized with oil. A principal advantage of this arrangement of the reservoir is that it provides in very close proximity to the piston a pressurized fluid source of large volume for reciprocating the piston. Accordingly, the required flow passages from the reservoir to the piston cylinder are relatively shorter than would otherwise be the case, thus resulting in a conservation of fluid energy and in a compact structure having a reduced number of parts.

The reservoir is in direct communication at all times by means of a first outlet port 27 with an annular area at 28 in the cylinder fronting the shoulder 21 of the piston, whereby the piston is constantly biased in a return direction by the pressure of reservoir fluid acting over its front end.

A control valve 29 (FIGS. 1–4) is operable to expose the relatively greater rear area (23, 24) of the piston alternately to the pressure of reservoir fluid from a second reservoir outlet port 31 (FIG. 2) and to a pressure fluid relief line 32 to sump (FIGS. 3–4), so as to effect hydraulic reciprocation of the piston. The recessed back area 24 of the piston is exposed to the pressure fluid through radial ports 30 formed in a hollow portion of the drive shaft.

CONTROL VALVE

Figure 4:
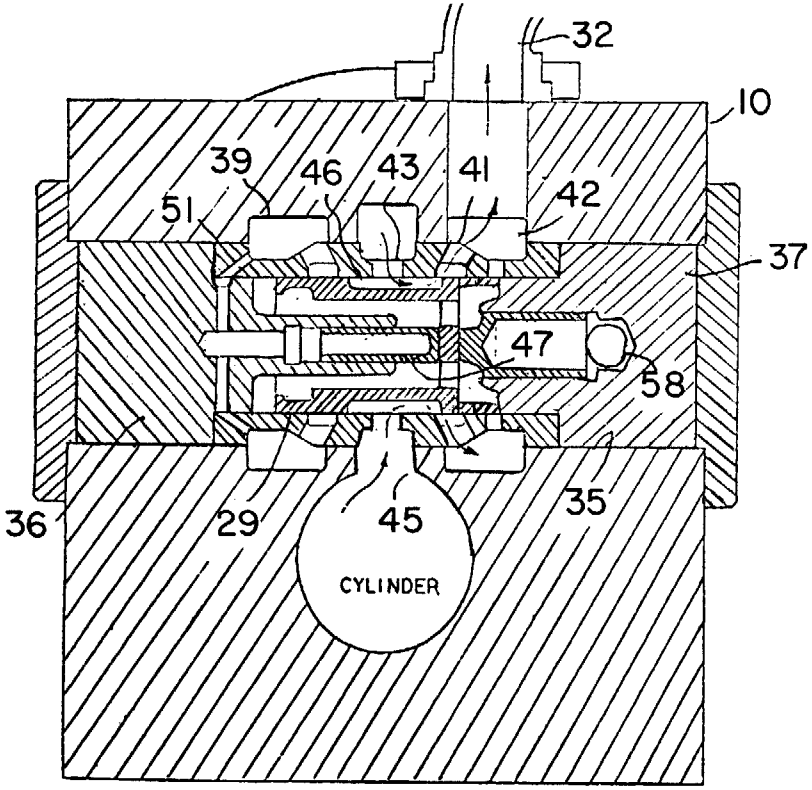
FIG. 4 is a view similar to that of FIG. 3 but showing the control valve shifted to its relief or discharge position.
Figure 3:
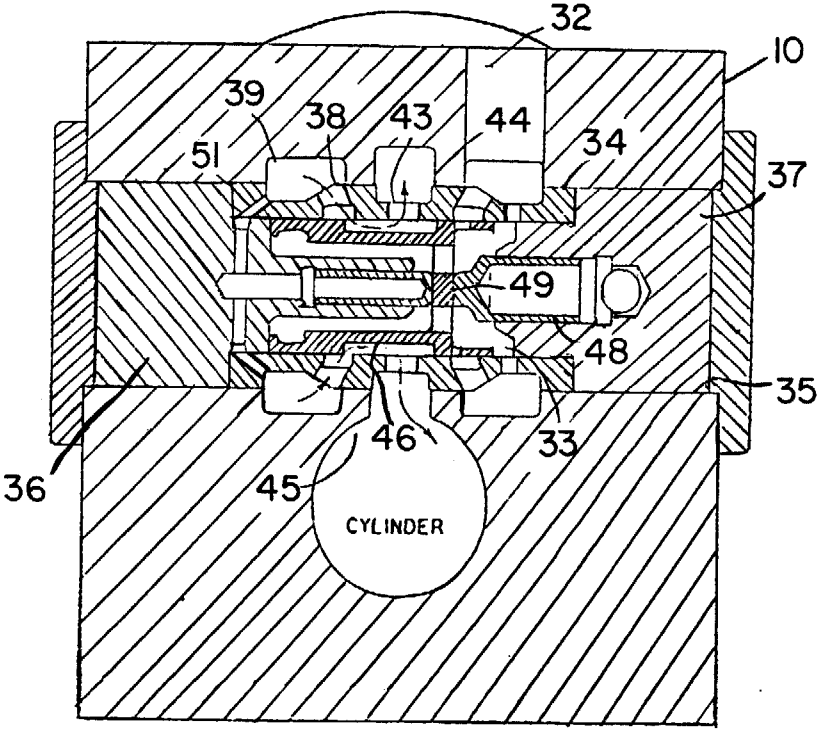
FIG. 3 is a section on line 3-3 of FIG. 1A showing the control valve in its pressure fluid feeding position.
Figure 2:
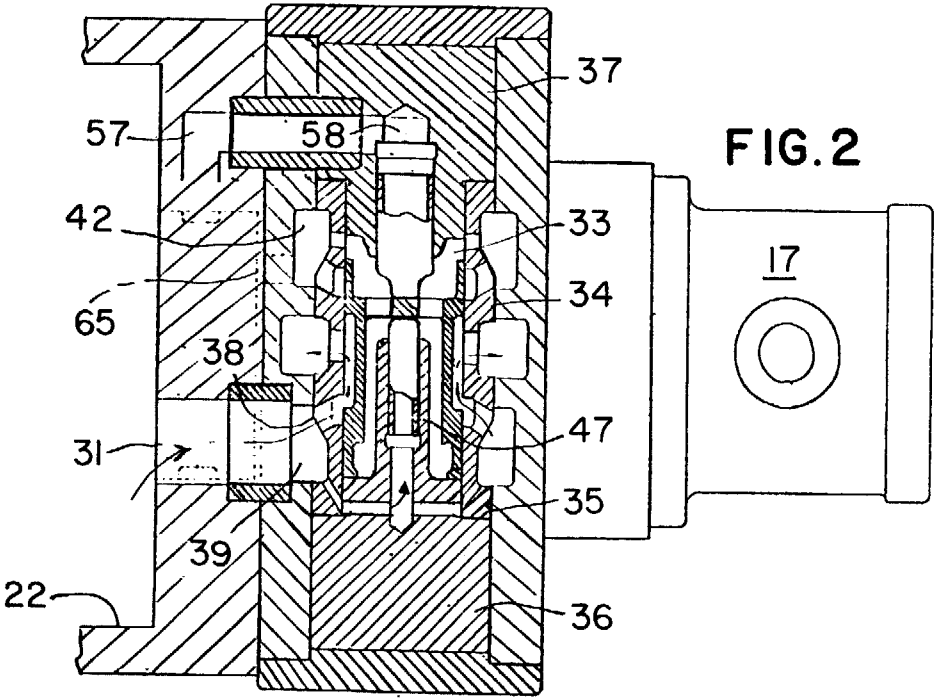
FIG. 2 is a section on line 2-2 of FIG. 1A.
Figure 5:
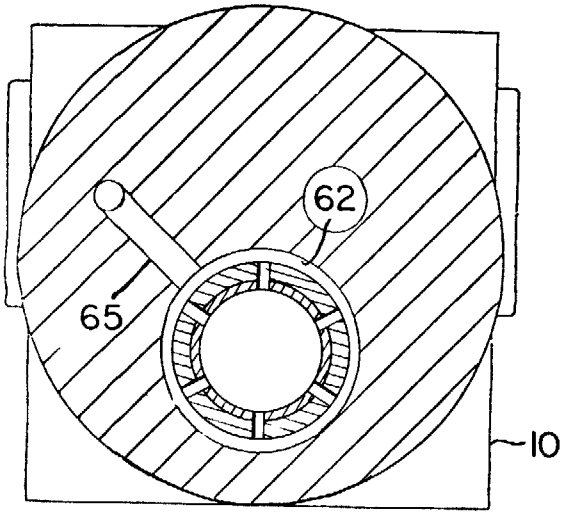
FIG. 5 is a section on line 5-5 of FIG. 1A.

The control valve, as indicated in FIGS. 2–4, is reciprocable in a chamber 33 defined by a bushing 34 fitted in a bore 35 of the housing. Opposite ends of the bushing and bore are sealed by means of plugs 36 and 37.

Inlet ports 38 (FIGS. 2, 3) connect the valve chamber 33 through a peripheral inlet groove 39 of the bushing with the second reservoir outlet port 31. Discharge or pressure fluid relief ports 41 (FIG. 4) connect the valve chamber 33 through a peripheral relief groove 42 of the bushing with the relief line 32. Common ports 43 connect the valve chamber through a peripheral groove 44 in the bushing with an annular area 45 of the piston cylinder rearwardly of the piston.

Ports 43 are common in that they are connectible by means of a peripheral groove 46 about the control valve with either the inlet ports 38 or the relief ports 41, accordingly as the valve is reciprocated from one position to another. In a first, or pressure fluid feed position of the valve (as in FIG. 3) groove 46 connects the inlet ports 38 through the common ports 43 with the area 45 rearwardly of the piston to effect a work stroke of the piston; and in an opposite second or pressure fluid relief position, (as in FIG. 4) groove 46 communicates the rear area 45 of the piston cylinder with the relief ports 41 to effect a return stroke of the piston under the bias of the reservoir fluid constantly acting on the front end 21 of the piston.

The control valve is caused to be shifted back and forth in its chamber from one position to the other relative to the inlet and relief ports 38 and 41 by means of a pair of opposed hollow plungers 47, 48. The plungers are alternately movable against one or the other of the opposed faces of an internal web 49 of the valve to effect a corresponding directional movement of the valve.

The plunger 47 (FIG. 4), called a biasing plunger, is constantly biased against the web 49 by pressure of reservoir fluid constantly being applied to its rear. Plunger 47 is slidably supported in the bushing plug 36 for axial movement relative to the web 49. The interior of the plunger is connected through ports 51 with the inlet groove 39, whereby the pressure of reservoir fluid from the reservoir outlet 31 constantly pressing the plunger against the web biases the valve toward its FIG. 4 relief position.

The opposite plunger 48 (FIG. 3) called an operating plunger, is slidably supported in the other bushing plug 37 for axial movement relative to the web 49 of the valve. It has a rear area relatively greater than that of plunger 47 so that when reservoir pressure fluid is applied to plunger 48 the latter forces the valve against the bias of plunger 47 to the FIG. 3 pressure fluid feeding position. And, when the pressure of reservoir fluid is relaxed or relieved from the operating plunger, the biasing force continually acting on plunger 47 acts through the web 49 to re-shift the valve to its FIG. 4 relief position.

Operation of the plungers and, as a consequence, the reciprocation of the control valve is determined by piston 13, accordingly as the latter is reciprocated.

When the control valve obtains its FIG. 4 relief position, reservoir fluid constantly being applied through the first reservoir outlet port 27 (FIG. 1A) to the front end 21 of the piston operates to move the piston on a return stroke. In this directional movement, a peripheral land 52 (FIG. 1A) of the piston progressively uncovers ports 53 of the piston cylinder to allow reservoir fluid from port 27 to pass around the piston to a groove 55 and from the latter through a passage 57 (FIGS. 1A, 2) in the housing to a chamber 58 at the rear of the operating plunger 48. Near the end of the return stroke of the piston, sufficient reservoir fluid pressure will have developed in chamber 58 to force the operating plunger to re-shift the control valve to its FIG. 3 pressure fluid feeding position. But, before this occurs, the piston is still moving rearwardly on its return stroke and before its back end 24 can limit against the stationary front end 59 of the drive shaft, the force of reservoir fluid now beginning to feed through the shifted valve to the rear of the piston conflicts with the force of oil being backed through the control valve by the rearwardly moving piston. This conflict of forces reduces the rearward velocity of the piston to zero before the piston can abut the drive shaft at 59. The reservoir fluid entering through the shifted valve to the rear area of the piston then develops sufficiently to drive the piston forwardly on a work stroke.

Now, as the piston moves forwardly on a work stroke, the piston land 52 progressively covers over ports 53 leading to the rear area 58 of the operating plunger, and uncovers a relief port 61. Uncovering the latter allows pressure fluid from the rear area 58 of the operating plunger to now be relieved through the piston cylinder around a rear groove 62 of the piston and a port 63 connecting through a relief passage 65 in the housing to the annular relief groove 42 (as indicated in FIG. 2). The piston continues moving forwardly until the fluid pressure at the rear of the operating plunger 48 will have been relieved sufficiently to allow the pressure of reservoir fluid at the second reservoir outlet 31 continuously acting on the biasing plunger 47 to cause the latter to shift the control valve to its pressure fluid relief position, as in FIG. 4. After the control valve has shifted to its FIG. 4 relief position, the driving pressure at the rear area 45 of the piston will be relieved to allow the pressure fluid constantly acting over the front end of the piston to become effective in returning the piston.

TOOL FEED MEANS

Figure 1B:
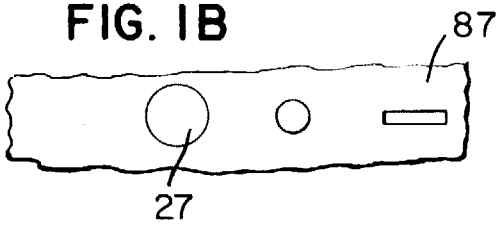
FIG. 1B is a detail section looking in the direction of the arrows 1B in FIG. 1A.
Figure 1A:
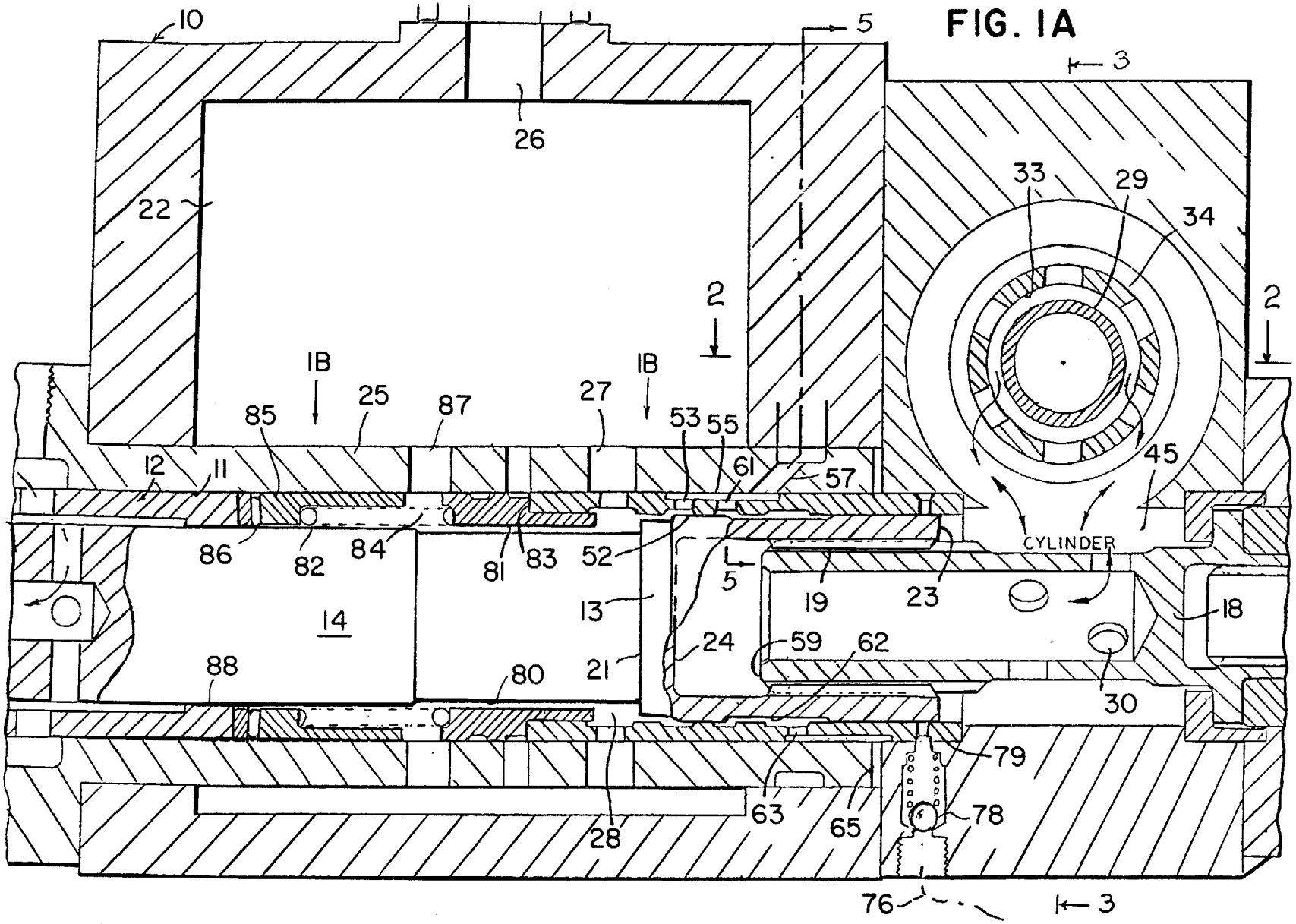
FIG. 1A is an enlarged view made of the central area of FIG. 1 for added clarity.
Figure 6:
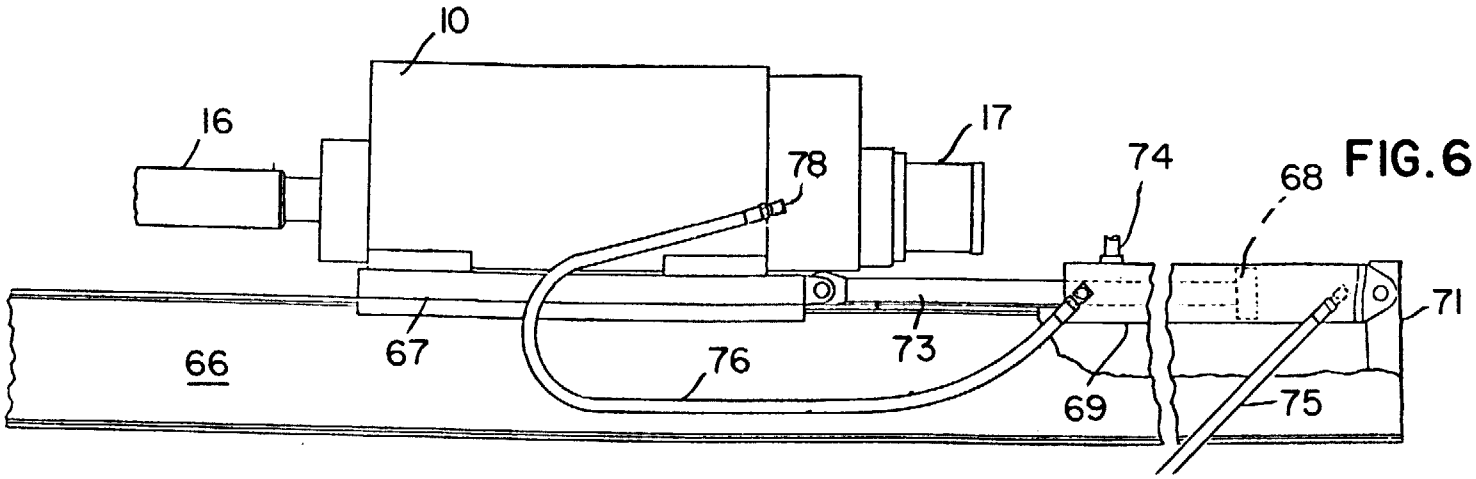
FIG. 6 is a schematic showing of the tool in association with the carriage feed mechanism.

Automatically operable hydraulic feed means is provided (as indicated in FIGS. 1, 1A and 6) for advancing the tool forwardly with the progress of the rock bit into the work. The feed means includes a conventional stationary guide channel 66 upon which a feed carriage 67 fixed to the underside of the tool's housing is slidably mounted for guided feeding of the tool relative to the work.

Thrust for sliding the carriage along the channel is provided by a feed piston 68 which is hydraulically operable in a feed cylinder 69. The latter cylinder is pivotally attached at its rear by means of a yoke to a post 71 of the guide channel. The feed piston carries in axial alignment with the carriage an externally projecting rod 73 which is pivotally connected to the carriage.

The feed cylinder is normally filled forwardly of piston 68 with oil from a supply hose 74 fitted with a manually operable control valve; and the cylinder area rearwardly of piston 68 is maintained under constant hydraulic pressure through a pressure supply hose line 75. The forward end of the feed cylinder connects by means of a hose line 76 through a ball check valve at 78 with feed control ports 79 opening into the rear area 45 of the power piston cylinder 12.

The power piston 13 is adapted on its return stroke to cover over the control feed ports 79; and is adapted toward the end of its forward stroke, that is, at about the time that the rock bit is carried by the power piston into engagement with the work to uncover the control feed ports.

It can be seen from this arrangement of the feed means that during the time that the feed control ports 79 are covered or blocked by the power piston 13, oil at the forward end of the feed cylinder 69 is trapped and hydraulically locks the feed piston 68 from advancing the carriage under the pressure of the fluid being constantly applied to the rear of the feed piston. But, as the power piston moves forwardly on a power stroke and progressively uncovers the feed control ports 79, the oil at the front end of the feed cylinder is forced by the pressurized feed piston past the ball check valve 78 through the feed control ports into the rear area 45 of the power cylinder 12. Accordingly, as the oil from the feed cylinder is being relieved through the check valve into the power cylinder, the feed carriage 67 together with the attached tool will be hydraulically advanced by the feed piston along the guide channel relative to the work. As can be seen, the tool will, in effect, be feeding forwardly concurrently with the advance of the rock bit into the work.

Conventional manually operable controls (not shown) are interconnected with the feed cylinder by appropriate hydraulic hose lines to rapidly advance the carriage along the guide channels at the start of operations to properly locate the tool relative to the work; and, when needed, to rapidly retract the carriage along the channel to add further lengths of drill rod to the drill string.

POWER PISTON SNUBBER

An axially slidable hydraulically cushioned snubber 81 (FIG. 1A) is positioned at a predetermined point in the path of forward movement of the power piston 13. During normal stroking the power piston will not move sufficiently forwardly relative to the cylinder to strike the snubber. However, as may occur should the rock bit plunge through a void in the work rock on a work stroke, the power piston may override sufficiently to strike the snubber. In such an event, the snubber would serve to snub and absorb the shock of such action.

The snubber is of cylindrical form disposed with a slight clearance, indicated at 80, in surrounding relation to the piston rod. It is normally seated against an internal shoulder 83 of a rear section of the piston cylinder under bias of a return spring 82 and primarily under pressure of reservoir oil acting in a space 84 normally existing below the snubber.

The return spring 82 is seated in a retaining cup 85. The latter surrounds the piston rod with a slight clearance, and is seated upon a thrust bearing 86 above a shoulder of a forward section of the piston cylinder.

Reservoir ports 27 and narrow slits 87 (FIGS. 1A, 1B) communicate oil from the reservoir to the area 28, to the space 84 and to the clearance 80. As the power piston reciprocates during normal stroking relative to the snubber and spring cup, the reservoir oil is caused to circulate through the ports 27 and slits 86 around the clearance 80 and in and out of the piston cylinder relative to the snubber. A land 88 of the piston cylinder has a bearing relation to the piston rod so as to block escape of oil from the space 84 beyond the bearing 86.

In the event, as earlier mentioned, the power piston should be caused to override and strike the snubber, the latter will slide forwardly against the bias of the return spring over the slits 87 to restrict and substantially close the latter so as to trap the oil beneath the snubber against rapid escape to the reservoir. As a result, overriding forward movement of the power piston will be damped, and substantially slowed or arrested.

As earlier said, the power piston during normal stroking will not strike the snubber. This is because the power piston is adapted to uncover the feed control ports 79 before its front end 21 reaches the snubber and, as a consequence, forward feeding of the tool develops while the power piston is still moving forwardly. During this forward feeding, the tool and the power piston advance simultaneously relative to the work, thereby normally avoiding impacting of the power piston against the snubber.

I claim:

1. An hydraulic rock drill comprising a main piston cylinder, a power piston hydraulically reciprocable in the cylinder having an externally projecting rod portion carrying a drill string with a rock bit, control valve means for causing effective application of hydraulic driving fluid alternately to forward and rear ends of the piston to reciprocate the latter, the piston adapted upon a return stroke to draw the rock bit away from the work a predetermined distance and adapted upon a work stroke to carry the rock bit forwardly over an initial lost motion distance before engaging the rock bit with the work; characterized by hydraulically operable feed means effective upon completion of said lost motion action to advance the rock drill concurrently with the rock bit relative to the work, the feed means comprising a slide carriage supporting the rock drill upon a guide channel, a carriage feed piston operable in a feed cylinder and having a piston rod connection with the carriage, pressurized oil in the feed cylinder rearwardly of the feed piston constantly urging the feed piston in a carriage advancing direction, oil filling the feed cylinder forwardly of the feed piston, an oil relief conduit connecting the area of the feed cylinder forwardly of the feed piston with a relief port opening into a rear area of the main piston cylinder, the relief port adapted to be covered over by the power piston in a returned position of the latter whereby relief of oil from the feed cylinder forwardly of the feed piston is blocked so as to disable forward movement of the feed piston and consequent advance of the carriage, and the relief port being adapted to be uncovered by the power piston following a predetermined degree of lost motion movement of the power piston on a work stroke so as to cause relief of the oil forwardly of the feed piston and enable the feed piston to advance the carriage concurrently with further movement of the power piston on a work stroke.

2. An hydraulic rock drill as in claim 1, wherein the power piston has a forward end constantly exposed to a source of pressurized fluid urging the power piston in a return direction, and the control valve means is pneumatically operable to cause alternate application to and relief of pressurized fluid from an opposite rear greater diameter end of the power piston.

3. An hydraulic rock drill as in claim 2, wherein the control valve means includes a control valve slidable to a first position communicating the rear end of the power piston to a relief port and slidable to a second position communicating the rear end of the power piston with a source of pressurized fluid, a pneumatically pressurized plunger constantly biasing the control valve to its first position, an opposed second plunger pneumatically operable against the control valve to slide it to its second position, and port means effective upon a predetermined extent of relative return movement of the power piston to communicate a source of pressurized fluid operatively with the second plunger.

* * * * *